United States Patent [19]

Hadank et al.

[11] Patent Number: 5,002,454

[45] Date of Patent: Mar. 26, 1991

[54] INTUITIVE JOYSTICK CONTROL FOR A WORK IMPLEMENT

[75] Inventors: John M. Hadank, Dunlap; William E. Allen; Walter J. Bradbury, both of Peoria, all of Ill.; Paul D. Anderson, Kent, Wash.

[73] Assignee: Caterpillar Inc., Peoria, Ill.

[21] Appl. No.: 501,381

[22] Filed: Mar. 19, 1990

Related U.S. Application Data

[63] Continuation of Ser. No. 241,654, Sep. 8, 1988, abandoned.

[51] Int. Cl.[5] ..... E02F 3/32

[52] U.S. Cl. ..... 414/695.5; 180/333; 74/471 XY

[58] Field of Search ..... 414/694, 5, 786, 695.5; 74/471 XY, 479; 180/315, 333

[56] References Cited

U.S. PATENT DOCUMENTS

| | | | |
|---|---|---|---|
| 3,388,821 | 6/1968 | White, Jr. | 214/778 |
| 3,608,743 | 9/1971 | Mosher et al. | 901/21 X |
| 3,800,969 | 4/1974 | Steiger | 214/778 |
| 3,840,132 | 10/1974 | Howells, Jr. et al. | 414/694 |
| 3,880,304 | 4/1975 | Strickland, Jr. | 214/138 |
| 4,059,196 | 11/1977 | Uchino et al. . | |
| 4,645,030 | 2/1987 | von Bernuth et al. | 180/333 |
| 4,667,909 | 5/1987 | Curci | 74/471 XYX |

FOREIGN PATENT DOCUMENTS

| | | |
|---|---|---|
| 2230897 | 12/1972 | Fed. Rep. of Germany . |
| 2235014 | 1/1975 | France . |

*Primary Examiner*—David A. Bucci
*Assistant Examiner*—Donald W. Underwood
*Attorney, Agent, or Firm*—James R. Yee; Robert E. Muir

[57] ABSTRACT

The work implements on earthmoving and material handling vehicles are generally controlled with two or more operator control handles or pedals that do not intuitively correspond to the movement of the implement. Generally, the assignment of the implement linkages to the controls is entirely arbitrary, and there exists little correlation between the direction of movement of the implement linkages and those of the control levers and pedals. Inconsistencies also abound between manufacturers and even among different type vehicles within a single manufacturer. These problems compromise the ability and productivity of even the most skilled operator. The invention comprises of two multi-axis joysticks that provide the operator an intuitive control interface to the vehicle. The control system of the invention also provides a coordinated control for spatial placement of the end effector of the work implement.

11 Claims, 4 Drawing Sheets

INTUITIVE JOYSTICK CONTROL FOR A WORK IMPLEMENT

This is a continuation of Application No. 07/241,654, filed Sep. 8, 1988.

TECHNICAL FIELD

This invention relates generally to a control system for controlling a work implement on a work vehicle, and more particularly to a control system which provides an intuitive control interface between the work implement and the vehicle operator.

BACKGROUND ART

In the field of work vehicles, particularly those vehicles which perform digging or loading functions such as excavators, backhoe loaders, and front shovels, the work implements are generally controlled with two or more operator controls in addition to other vehicle function controls. The manual control system often includes foot pedals as well as hand operated levers. The Case backhoe, for example, employs three levers and two pedals to control the digging implement, and the Ford backhoe has four levers to control the same. There are serious drawbacks associated with these implement control schemes. One is operator stress and fatigue resulting from having to manipulate so many levers and pedals. A vehicle operator is required to possess a relatively high degree of expertise to manipulate and coordinate the multitude of control levers and foot pedals proficiently. To become productive, an inexperienced operator also requires a long training period to be familiar with the controls and their functions.

Some manufacturers recognize the disadvantages of having too many controls, and have adopted a two-lever control scheme as the norm. Generally, the two vertically mounted two-axis levers share the task of controlling linkages (boom, stick, and bucket) of the work implement. For example, presently Caterpillar excavators employ one joystick for stick and swing control, and another joystick for boom and bucket control. Similarly, John Deere has a joystick for boom and swing control, and another for stick and bucket control. In each instance, the number of controls has decreased to two, making machine operation much more manageable. However, the two-lever control scheme presently used in the industry still has an undesirable property. As can be easily seen from the Caterpillar and Deere machines, the assignment of implement linkages to the joysticks is entirely arbitrary, and there exists little correlation between the direction of movement of the work implement linkages and those of the control levers. Thus, to cause the boom to rise, the stick to move toward the vehicle and the bucket to curl as in a typical leveling operation on a Caterpillar excavator, the operator manipulates the right-hand joystick diagonally toward the rear and left of the vehicle for bucket curl and boom raise, and the left-hand joystick toward the rear of the vehicle for stick movement. This is contrary to natural expectations and requires acute concentration of even an experienced operator, resulting in fatigue, mental stress, and diminished productivity. Furthermore, because there is no industry standard, inconsistencies abound between manufacturers and even among different excavator-type machines within a single manufacturer. Such inconsistencies compromises the ability and productivity of even the most skilled operator to adapt to different equipment and to different manufacturers.

The requirement of correlating the implement movement intuitively to the controls has only been partially satisfied in known systems.

One such system is described in U.S. Pat. No. 4,059,196 issued to Uchino et al. on Nov. 22, 1977. The control system disclosed therein includes a manual control lever in the form of a miniature work implement consisting of a miniature boom, stick and bucket. To dig, the operator in effect manipulates all three elements of the miniature control implement to go through the same motions as the digging implement. Uchino's master-slave control system addresses the problem of correlating the controls to the work implement, but the three-element control lever effectively is a three lever control system that inherently has the same aforementioned multiple control problems. Furthermore, the control system not only does not afford the operator a comfortable grip, it is also awkward to manipulate, position, and coordinate all three elements to mimic the normal course of operations of the boom, stick, and bucket. The control lever is also not of conventional design requiring special manufacture.

Another known system described in U.S. Pat. No. 4,645,030 issued to von Bernuth et al. on Feb. 24, 1987. Von Bernuth disclosed a multi-function directional control unit that contains various control levers, switches, and buttons in which each separate control element is associated with a work movement. Although the direction of the human control movements mostly agree with that of the implement movements controlled, the interface constituted by von Bernuth's control unit is not intuitive, nor does it conform to natural expectations. Furthermore, It still requires that the operator become familiar with the one to one mapping of each control element to its respective function, and the multiple control elements easily make operating the machine confusing and demanding. This system is also of special design requiring special manufacture.

The present invention is directed to overcome the problems as set forth above.

DISCLOSURE OF THE INVENTION

It is the primary objective of the instant invention to provide an entirely intuitive control interface between the operator and the vehicle work implement. The control elements and the direction and speed of implement movements they control have a logic correlation between thereof.

It is the secondary objective of the instant invention to provide a control system that is easily manipulable to reduce operator stress and fatigue.

It is the third objective of the instant invention to provide a control system employing control elements of conventional form and design, and require no special manufacture.

In one aspect of the invention, the control system is for controlling a work implement on a vehicle. The work implement includes a boom pivotally connected to the vehicle, a stick pivotally connected to the boom, and a bucket pivotally connected to the stick. In normal operation, the boom, stick, and bucket each are independently, controllably, and pivotally moveable in a first substantially vertical plane relatively one to the other. The boom, stick, and bucket are also simultaneously, controllably, pivotally swingable to a plurality of second substantially vertical planes different from the first plane. The boom, stick and bucket are controllably actuated by hydraulic actuating means in response to received work implement control signals generated by a microprocessor system under software control. The control system comprises a first joystick being universally moveable along first and second axes in a plane perpendicular to its longitudinal central axis, being rotatably moveable about the longitudinal central axis thereof, and being adapted for delivering a first set of electric signals corresponding to the displacement and direction of said first joystick from said longitudinal central axis in first and second axes in said first plane and rotational displacement and direction thereof. Additionally, the control system includes a second joystick being universally moveable along a third axis in a plane perpendicular to its longitudinal central axis, and being adapted for delivering a second set of electric signals corresponding to the displacement and direction of said second joystick from said longitudinal central axis along the third axis different from said first and second axes. The first and second sets of electric signals are received by a control means which delivers a plurality of work implement control signals to the hydraulic actuating means in response. The control algorithm is such that the vertical motion of the boom is identical to the direction of movement of said first joystick along said first axis, the horizontal motion of the stick is identical to the direction of movement of the first joystick along said second axis, the curling motion of the bucket is identical to the direction of rotational movement of said first joystick about the longitudinal central axis, and the swinging motion of the work implement to the plurality of second planes is identical to the direction of movement of said second joystick along the third axis.

In another aspect of the invention, the control system further comprises control means for delivering a plurality of work implement control signals to the hydraulic actuating means in response to receiving said first and second sets of electric signals. The vertical motion of the bucket is exactly spatially identical to the direction of movement of said first joystick along said first axis, the horizontal motion of the bucket is exactly spatially identical to the direction of movement of the first joystick along said second axis, the curling motion of the bucket is exactly spatially identical to the direction of rotational movement of said first joystick about the longitudinal axis, and the swinging motion of the work implement to the plurality of second planes is identical to the direction of movement of said second joystick along the third axis. Said bucket motion is the result of coordination of the boom, stick, and bucket.

The instant invention considerably lowers the training time required of an inexperienced operator to learn the system. In addition, since the system is intuitive and not of arbitrary control element-function mapping, it can easily be adopted as the industry standard, thus eliminating inconsistencies between manufacturers and between all excavator-type machines. The joysticks in the instant invention are of conventional design and manufacture. The invention also includes other features and advantages which will become apparent from a more detailed study of the drawings and specification.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
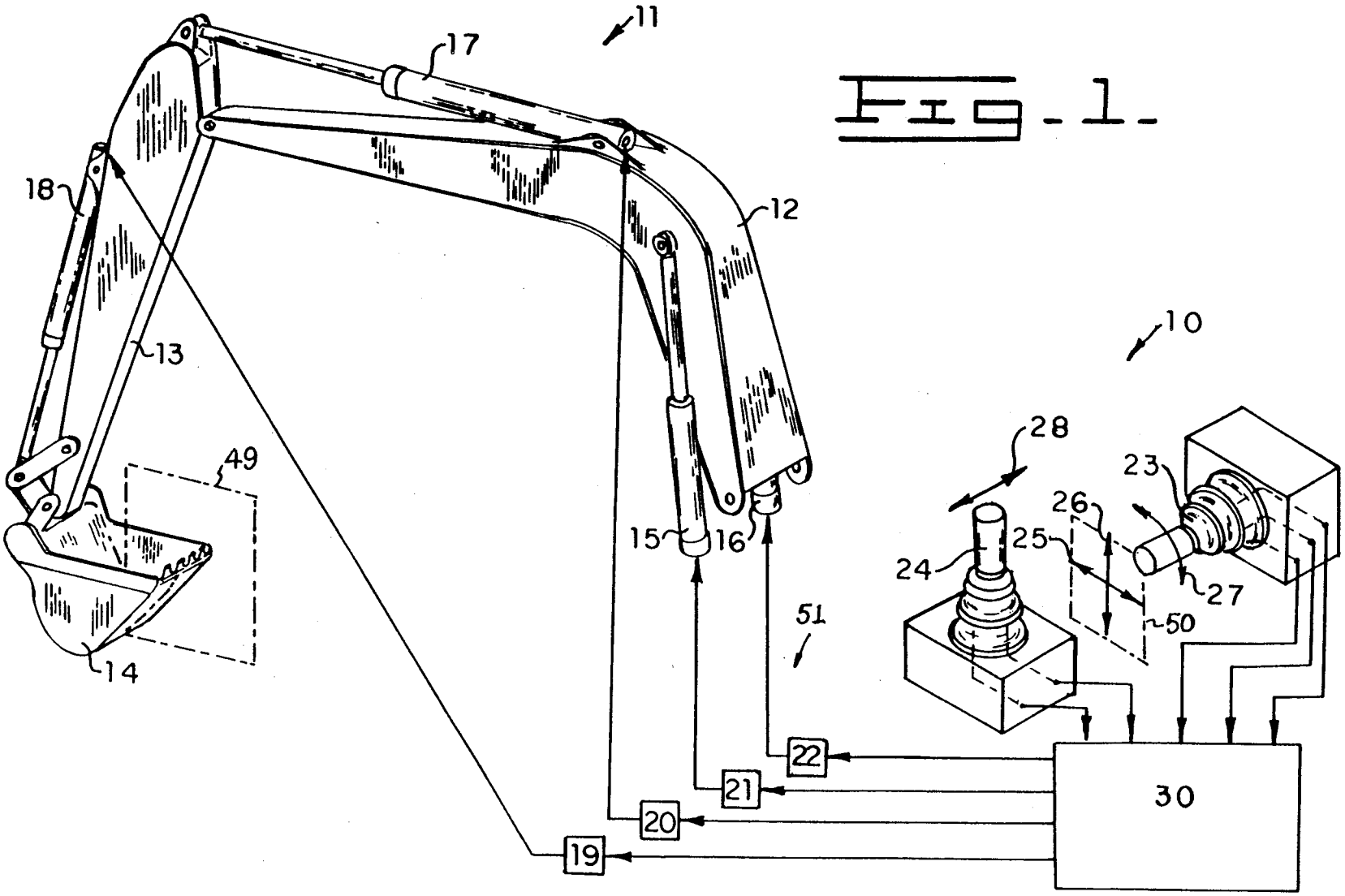
FIG. 1 is a diagrammatic view of the intuitive joysticks control system and the work implement.

Referring to FIG. 1 a diagrammatic view of an embodiment of the intuitive joystick control system 10 is shown. Vehicles suitable for the application of the instant control system are excavator-type earthmoving or logging machinery, such as excavators, backhoe loaders, front shovels, wheel loaders, track loaders, and skidders (vehicles not shown). The work implement 11 under control typically consists of linkages such as a boom 12, stick 13, and bucket 14. However, the implement configuration can differ from machine to machine, and the configuration may include an end effector other than a bucket such as a grapple. In certain machines, such as the excavator, the operator cab together with the work implement is rotatable along a vehicle center axis; in others, such as a backhoe loader, the operator cab is stationary and the work implement is swingable to a different site at the pivot at the base of the boom. This difference is noted and the implementation of the intuitive joystick control system is substantially identical.

The work implement 11 of the vehicle is generally actuated in a vertical plane 49, and swingable to a plurality of second planes different from the first plane by rotating the vehicle platform or swinging at the pivot base of the boom. The boom 12 is actuated by two hydraulic cylinders 15,16, enabling raising and lowering of the work implement 11. The stick 13 is drawn toward and outward from the vehicle by a hydraulic cylinder 17. Another hydraulic cylinder 18 "opens" and "closes" the bucket. The hydraulic flow to the implement cylinders are regulated by hydraulic control valves 19,20,21,22.

The operator interface for the control of the work implement consists of two joysticks mounted horizontally and vertically for easy reach on the right and left hand side of the operator seat. The joysticks are inductive control levers of conventional design such as one manufactured by CTI Electronics of Bridgeport, Conn., but other types may also be used. The horizontally mounted joystick 23 has three axes of movement, all in one plane 50 substantially parallel to work implement plane 49: towards the front and rear of the vehicle (shown by arrow 25), vertically up and down (shown by arrow 26), and rotationally (shown by arrow 27) about its longitudinal central axis 52. The vertically mounted joystick 24 is moveable to the left and right of the vehicle (shown by arrow 28). The horizontally mounted joystick 23 generates one signal for each respective axis of movement, each signal representing the joystick displacement direction and velocity from neutral. Similarly, the vertically mounted joystick 24 generates a signal for the left-right displacement direction and velocity for implement side swing control. The electric signals are received by a controller 30, which in response delivers to the hydraulic control valves 19,20,21,22 a plurality of work implement control signals.

Figure 2:
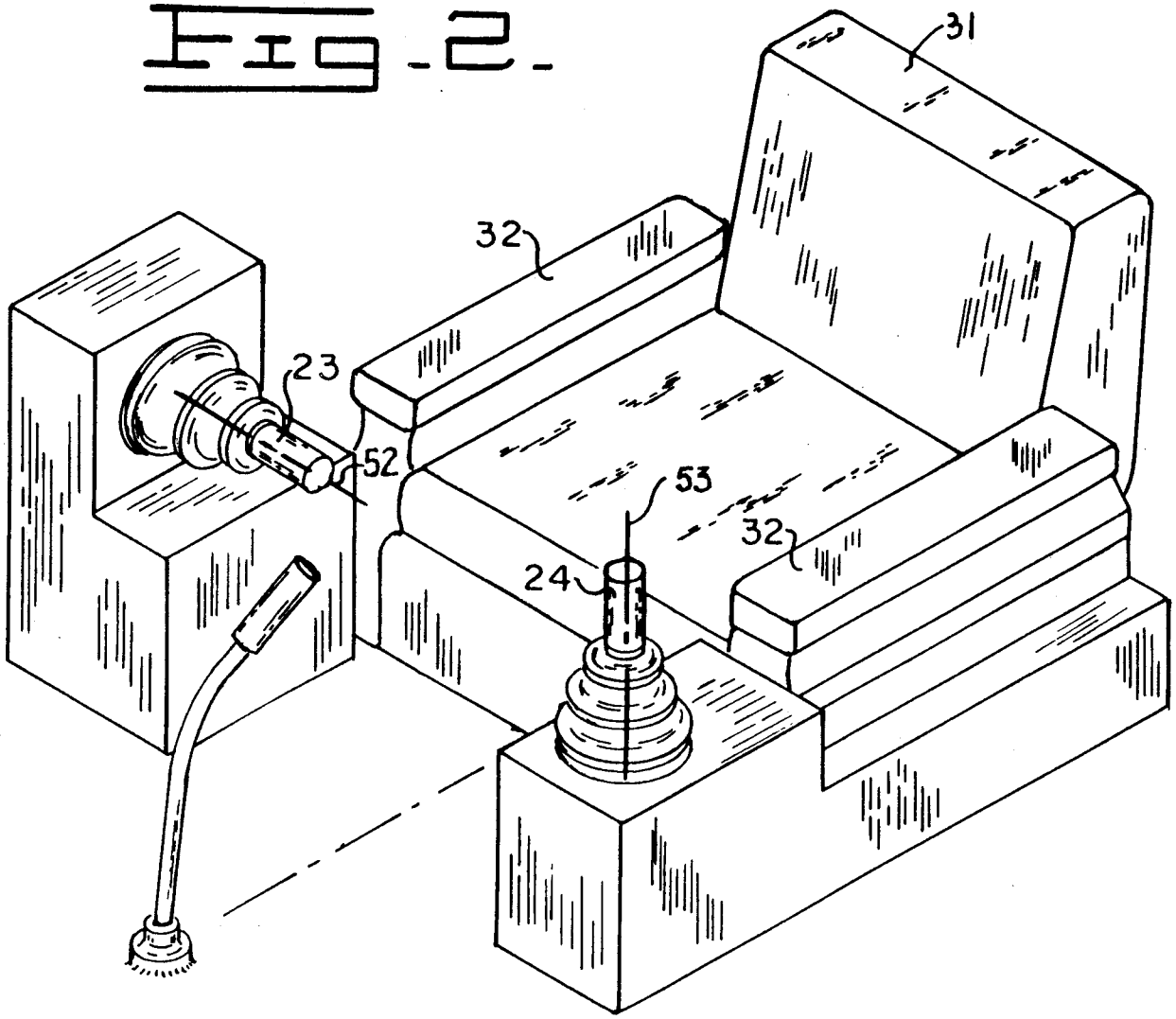
FIG. 2 is an isometric view of the intuitive joysticks control system mounted with respect to the operator seat.

Referring now to FIG. 2, an isometric view of the operator seating area and manual controls is shown. The operator, when seated in the seat 31, can rest his or her arms on arm rests 32 where the joysticks 23,24 are within easy reach.

In one embodiment of the instant invention, the joysticks control the work implement linkages independently. In this embodiment, each axis of movement of the horizontally mounted joystick corresponds to a specific linkage on the implement. This is similar to the current conventions of excavator-type machine controls. Thus, the operator is required to compensate for the geometry of the work implement where each linkage follows an arc at each respective pivot point when actuated. In order to keep the bucket level in certain digging operations, for example, the operator has to compensate for the arc by raising and lowering the boom while controlling the stick movement and bucket curl. Although, this embodiment is still more intuitive than conventional designs.

Figure 3:
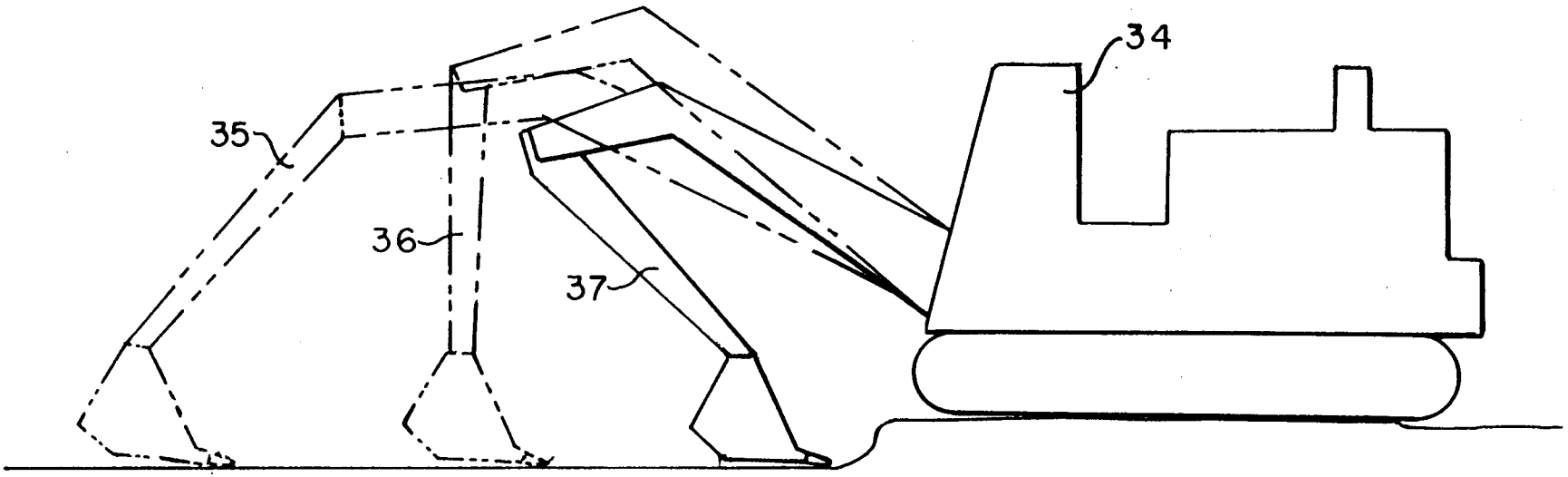
FIG. 3 is a side view of the vehicle performing bucket level motion with phantom lines illustrating implement movement.

In another and the preferred embodiment, the control of the linkage movements are simultaneously coordinated. Referring to FIG. 3, a vehicle 34 performing bucket level motion is shown. In drawing the bucket level toward the vehicle, all three linkages require simultaneous and coordinated control. In the first phantom outline 35, the stick is out and the bucket is in a closed position. As the implement is drawn to the position shown by the second phantom outline 36, the boom is raised, stick closer to the vehicle, and the bucket in a more open position. At the final position shown by the solid outline 37, the boom is lowered, the stick is drawn in, and the bucket is open. In a vehicle with conventional controls where each linkage is controlled independently, all the linkage motions are explicitly controlled and manipulated by the operator. Since the primary concern of the vehicle operator is the placement of the bucket, the second embodiment of the instant invention allows exact operator displacement and directional control of the bucket regardless of the geometry of the work implement. Therefore, to perform bucket level motion such as in floor finishing, the operator needs only move the horizontally mounted joystick 23 towards the front or rear of the vehicle.

Figure 4:
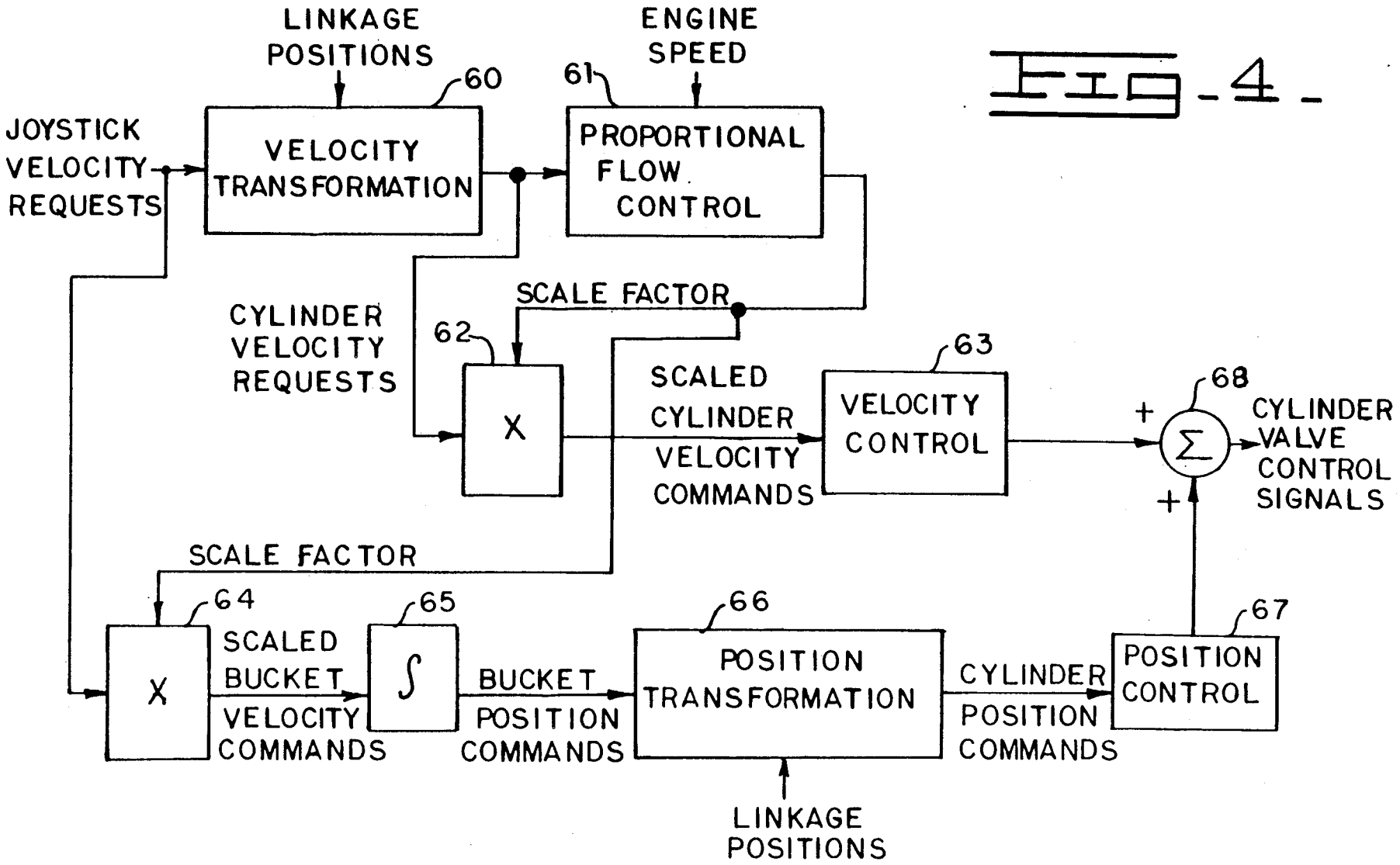
FIG. 4 is a block diagram of the coordinated control implementation.

Referring now to FIG. 4, a block diagram of the coordinated control implementation is shown. The electric signals which are generated by the joysticks are shown as joystick velocity request inputs to the block diagram. These velocity request signals are in cartesian coordinates corresponding to the joystick axes of movement. The velocity requests are transformed in block 60 to a different coordinate system based on the configuration and position of the linkages. The velocity transformation also receives linkage position data from sensors such as linkage angle resolvers and cylinder position sensors such as known in the art. Please refer to *Robot Manipulators: Mathematics, Programming and Control* by Richard P. Paul, MIT Press, 1981. The cylinder velocity requests (or joint angular velocity) from this translation process is scaled at a block 62 by a factor obtained in the proportional flow control block 61. Proportional hydraulic flow control is discussed in U.S. Pat. No. 4,712,376 issued to Hadank and Creger on Dec. 15, 1987. The basic concept of the proportional flow control involves calculating for the amount of hydraulic flow available for implement actuation under current operating conditions (i.e.: engine speed, vehicle travel, etc.) The resultant scaled velocity request from block 62 is passed on to velocity control block 63 where an open or closed loop control determines the hydraulic valve velocity control signals to satisfy the cylinder velocity request. Such open or closed loop control systems are well known in the field of control theory. The hydraulic control valve signals are complemented with another set of signals to eliminate errors introduced in the cartesian to linkage coordinate transformation. Referring now to block 64, the joystick velocity requests are scaled with the same factor obtained in proportional flow control. The scaled joystick velocity commands are integrated over time to obtain position commands 65 and transformed to the linkage coordinates 66. This transformation is similar to that of the transformation process in block 60. The output of position transformation block 66 is then passed on to another open or closed loop control 67 where hydraulic valve position control signal is determined. The hydraulic valve control signals from both branches are combined at 68 to arrived at the final cylinder valve control signals for the work implement.

The cartesian to linkage coordinate transformations discussed above uses the bucket pin as a reference point and does not take into consideration bucket tip position. However, if it is more intuitive for the operator to operate the vehicle with the bucket tip as the significant end point, translation can be easily expanded to accommodate the bucket linkage.

Industrial Applicability

The operation of the intuitive joystick control system is best described in relation to its use in the control of work vehicles, particularly those vehicles which perform digging or loading functions such as excavators, backhoe loaders, and front shovels. These vehicles typically include work implements with two or more linkages and several degrees of movement. The instant invention constitutes an intuitive interface for the operator to command the vehicle to perform its functions. The interface consists of two joysticks mounted horizontally and vertically on the right and left of the operator seat.

More particularly, to affect the end effector on the implement, the operator moves the joystick controls as if the implement is an extension of his left and right arms. To cause the implement to move outward from the vehicle, the operator pushes the right joystick outward towards the front of the vehicle. To cause the implement to move upward vertically, he raises the right joystick upward vertically. To cause the bucket to close or curl, he curls his wrist which in turn rotates the right joystick. In one embodiment, the direction and velocity of the implement linkages independently correspond directly to the movement of the joystick controls. In another embodiment, the joystick movements correspond directly to the movement of the bucket. The second embodiment is preferred since it provides the operator control of the spatial placement of the bucket at the work location. This is easy to envision if the human arm is likened to the work implement, with pivot points at the shoulder, elbow and wrist. When reaching for an object, the placement and movement of the arm, forearm, and the elbow are of no concern; the concentration is on the placement and path of motion of the hand. The left joystick controls the side swing of the implement to a different work site.

Because the control scheme meets the natural expectations, it should take considerably less time to become familiar and proficient at operating vehicles outfitted with the instant invention. It also reduces the stress and fatigue of the operator, because it takes considerably less concentration to operate. Moreover, the instant invention contributes to the establishment of an industry standard on excavator-type machine controls.

Other aspects, objects, and advantages of the instant invention can be obtained from a study of the drawings, the disclosure, and the appended claims.

We claim:

1. A control system for controlling a work implement on a vehicle, said work implement including a boom pivotally connected to the vehicle, a stick pivotally connected to the boom, and a bucket pivotally connected to the stick, said boom, stick, and bucket each being independently, controllably, and pivotally moveable in a first substantially vertical plane relatively one to the other, and actuating means for controllably actuating said bucket, stick and boom in response to received work implement control signals, the control system comprising:

a first joystick universally moveable along first and second axes in a plane perpendicular to its longitudinal central axis, and rotatably moveable about the longitudinal central axis thereof;

means for delivering a first set of electrical signals corresponding to the displacement and direction of said first joystick from said longitudinal central axis in the first and second axes of said first plane and to the rotational displacement and direction thereof; and control means for delivering a plurality of work implement control signals to the actuating means in response to receiving said first set of electrical signals, the vertical motion of the boom being identical to the direction of movement of said first joystick along said first axis, the horizontal motion of the stick being identical to the direction of movement of the first joystick along said second axis, and the curling motion of the bucket being identical to the direction of rotational movement of said first joystick about the longitudinal central axis.

2. The control system, as set forth in claim 1, wherein said boom, stick, and bucket are pivotally swingable to a plurality of second substantially vertical planes, said control system further comprising a second joystick universally moveable along a third axis in a plane perpendicular to its longitudinal central axis, and adapted for delivering a second set of electrical signals corresponding to the displacement and direction of said second joystick from said longitudinal central axis in said third axis different from said first and second axes, and wherein the control means delivers a plurality of work implement control signals to the hydraulic actuating means in response to receiving the second set of electrical signals so that the swinging motion of the work implement to the plurality of second planes is identical to the direction of movement of said second joystick along the third axis.

3. The control system, as set forth in claim 1, wherein the control means adjusts the magnitude of the plurality of work implement control signals so that the velocity of displacement of the boom, stick, and bucket in said first plane is directly proportional to the magnitude of displacement of said first joystick.

4. A control system for controlling a work implement on a vehicle, said work implement including a boom, a stick, and a bucket, said boom, stick, and bucket each being independently, controllably, and pivotally moveable in a first substantially vertical plane relatively one to the other, said boom, stick, and bucket being simultaneously, controllably, pivotally swingable to a plurality of second substantially vertical planes, and actuating means for controllably actuating said bucket, stick and boom in response to received work implement control signals, the control system comprising:

a first joystick universally moveable along first and second axes in a plane perpendicular to its longitudinal central axis, rotatably moveable about the longitudinal central axis thereof, and adapted for delivering a first set of electrical signals corresponding to the displacement and direction thereof from said longitudinal central axis in the first and second axes of said first plane and to the rotational displacement and direction thereof;

a second joystick universally moveable along a third axis perpendicular to its longitudinal central axis, and being adapted for delivering a second set of electrical signals corresponding to the displacement and direction of said second joystick from said longitudinal central axis in said third axis different form said first and second axes; and control means for delivering a plurality of work implement control signals to the actuating means in response to receiving said first and second sets of electrical signals, the vertical motion of the boom being identical to the direction of movement of said first joystick along said first axis, the horizontal motion of the stick being identical to the direction of movement of the first joystick along said second axis, and the curling motion of the bucket being identical to the direction of rotational movement of said first joystick about the longitudinal central axis, and the swinging motion of the work implement to the plurality of second planes being identical to the direction of movement of said second joystick along the third axis.

5. The control system, as set forth in claim 4, wherein the control means adjusts the magnitude of the plurality of work implement control signals so that the velocity of displacement of the boom, stick, and bucket in said first plane and said plurality of second planes is directly proportional to the magnitude of displacement of said first and second joysticks in the respective axes.

6. A control system for controlling a work implement on a work vehicle, the work implement comprising a stick, a boom, a bucket pivotally connected to one end of the stick, the stick being pivotally connected at its other end to one end of the boom, and the boom being pivotally connected at its other end to the work vehicle, said bucket, stick and boom each being independently, controllably, pivotally moveable in a plane relatively one to the other, and said bucket, stick and boom being simultaneously, controllably, pivotally moveable in an arc substantially normal to said plane, the plane extending substantially vertically, and hydraulic means for controllably actuating said bucket, stick and boom in response to received electrical control signals, the control system comprising:

a first control lever having an axis, extending substantially horizontally and being moveable in a first horizontal direction toward the front of the vehicle and the rear of the vehicle, in a vertical direction and rotatably moveable about said axis;

a second control lever extending substantially vertically and being moveable in a second direction substantially normal to the first horizontal direction;

electrical means for delivering respective electrical signals responsive to the direction and magnitude of movement of said control levers; and control means for actuating the work implement in response to receiving the electrical signals, the boom and the first control lever both moving in substantially the same vertical direction, the stick and the first control lever both moving in substantially the same horizontal direction relative to the vehicle, the bucket and the first control lever both moving in substantially the same direction relative to their respective pivotal axis and longitudinal axis, and the swing of the work implement and the second control lever both moving in substantially the same horizontal direction.

7. A control system for controlling a work implement on a vehicle, said work implement including a first linkage connected to the vehicle, a second linkage connected to the first linkage, and a working device connected to the second linkage, said linkages, and working device being controllably and pivotally movable in an upright plane relatively to each other, and actuating means for controlling said first linkage, second linkage and working device in response to control signals from the control system, the control system comprising:

a generally horizontally disposed joystick pivotally movable in first and second directions about a point on its longitudinal axis and rotatable about said longitudinal axis for generating electrical signals corresponding to the pivotable and rotational movements; and control means for delivering a plurality of work implement control signals to the hydraulic actuating means in response to receiving the electrical signals and so constructed and arranged that vertical motion of the first linkage is controlled by the pivotable movement of the joystick in the first direction, the horizontal motion of the second linkage is controlled by the pivotable movement of the joystick in the second direction, and the motion of the working device relative to the second linkage is controlled by the rotational movement of the joystick about its said longitudinal axis.

8. A system according to claim 7, wherein the first linkage is a boom, the second linkage is a stick pivotally connected to the boom, and the working device is a bucket pivotally connected to the stick.

9. A system according to claim 7, wherein the control means is selectively operable for coordinating the motions of the linkages and the working device to create a resultant linear motion of the working device.

10. A control system for controlling a work implement on a vehicle, said work implement including a first linkage connected to the vehicle, a second linkage connected to the first linkage, and a working device connected to the second linkage, said linkages and working device being controllably and pivotally movable in an upright plane relatively to each other and simultaneously, controllably, and swingably movable about an upright axis, further and actuating means for controlling said first linkage, second linkage and working device in response to control signals from the control system, the control system comprising:

a generally horizontally disposed first joystick movable in first and second directions and rotatable about its longitudinal axis to generate electrical signals corresponding to the movement;

an upright second joystick movable in a third direction to generate electrical signals corresponding to the movement; and control means for delivering a plurality of work implement control signals to the hydraulic actuating means in response to receiving the electrical signals, whereby vertical motion of the first linkage is controlled by movement of the first joystick in the first direction, the horizontal motion of the second linkage is controlled by movement of the first joystick in the second direction, the motion of the working device relative to the second linkage is controlled by the rotational movement of the first joystick about its said longitudinal axis, and the swinging motion of the work implement is controlled by the movement of the second joystick in the third direction.

11. A system according to claim 10, wherein the control means controls the speed of movement of the first linkage, second linkage, and working device to be directly proportional to the magnitude of movement of the first and second joysticks.

* * * * *